US006125344A

United States Patent [19]

Kang et al.

[11] Patent Number: 6,125,344

[45] Date of Patent: Sep. 26, 2000

[54] PITCH MODIFICATION METHOD BY GLOTTAL CLOSURE INTERVAL EXTRAPOLATION

[75] Inventors: Dong Gyu Kang; Jung Chul Lee; Sang Hun Kim; Jun Park, all of Daejeon, Rep. of Korea

[73] Assignee: Electronics and Telecommunications Research Institute, Daejeon, Rep. of Korea

[21] Appl. No.: 09/137,606

[22] Filed: Aug. 21, 1998

[30] Foreign Application Priority Data

Mar. 28, 1997 [KR] Rep. of Korea ..... 97-64040

[51] Int. Cl.[7] ..... G10L 21/00; G10L 13/00

[52] U.S. Cl. ..... 704/207; 704/205; 704/201; 704/264; 704/268; 704/258; 704/207

[58] Field of Search ..... 704/220, 201, 704/205–208, 223, 264

[56] References Cited

U.S. PATENT DOCUMENTS

| | | | |
|---|---|---|---|
| 5,138,661 | 8/1992 | Zinser et al. | 704/219 |
| 5,171,930 | 12/1992 | Teaney | 704/220 |
| 5,504,833 | 4/1996 | George et al. | 704/211 |
| 5,524,172 | 6/1996 | Hamon | 395/2.77 |
| 5,611,002 | 3/1997 | Vogten et al. | 395/2.76 |
| 5,617,507 | 4/1997 | Lee et al. | 704/200 |
| 5,970,440 | 10/1999 | Veldhuis et al. | 704/203 |

FOREIGN PATENT DOCUMENTS

| | | | |
|---|---|---|---|
| 0 527 527 A2 | 7/1992 | European Pat. Off. | G40L 3/02 |

OTHER PUBLICATIONS

Valbret et al. Voice transformation using PSOLA technique, Speech Communication 11 (1992) 175–187.

Moulines et al. Pitch–Synchronous Waveform Processing Techniques For Text–To–Speech Synthesis Using Diphones, Speech Communication 9 (1990) 4453–467.

*Primary Examiner*—Richemond Dorvil
*Assistant Examiner*—Daniel A. Nolan
*Attorney, Agent, or Firm*—Cohen, Pontani, Lieberman & Pavane

[57] ABSTRACT

The present invention relates to an improved pitch modification method by glottal closure interval extrapolation. It is an object of the present invention to modify pitches of speech signals by the glottal closure interval extrapolation and to maintain quality of the modified speech, when concatenating original speech segments to synthesize speech. An input speech signal is converted into a digital speech signal. A glottal closure interval is detected in the digital speech signal so as to estimate vocal tract parameters by using pitch synchronous analysis. Vocal tract characteristic signals of the glottal closure interval and glottal characteristic signals of a glottal open interval are separated from each other according to the detected glottal closure interval. The separated vocal tract characteristic signals are extrapolated and reduced to a desired pitch length by the estimated vocal tract parameter. The extrapolated and reduced vocal tract characteristic signals are overlapped and added to the separated glottal characteristic signal so as to generate a synthetic speech signal which varies in a desired pitch length.

6 Claims, 6 Drawing Sheets

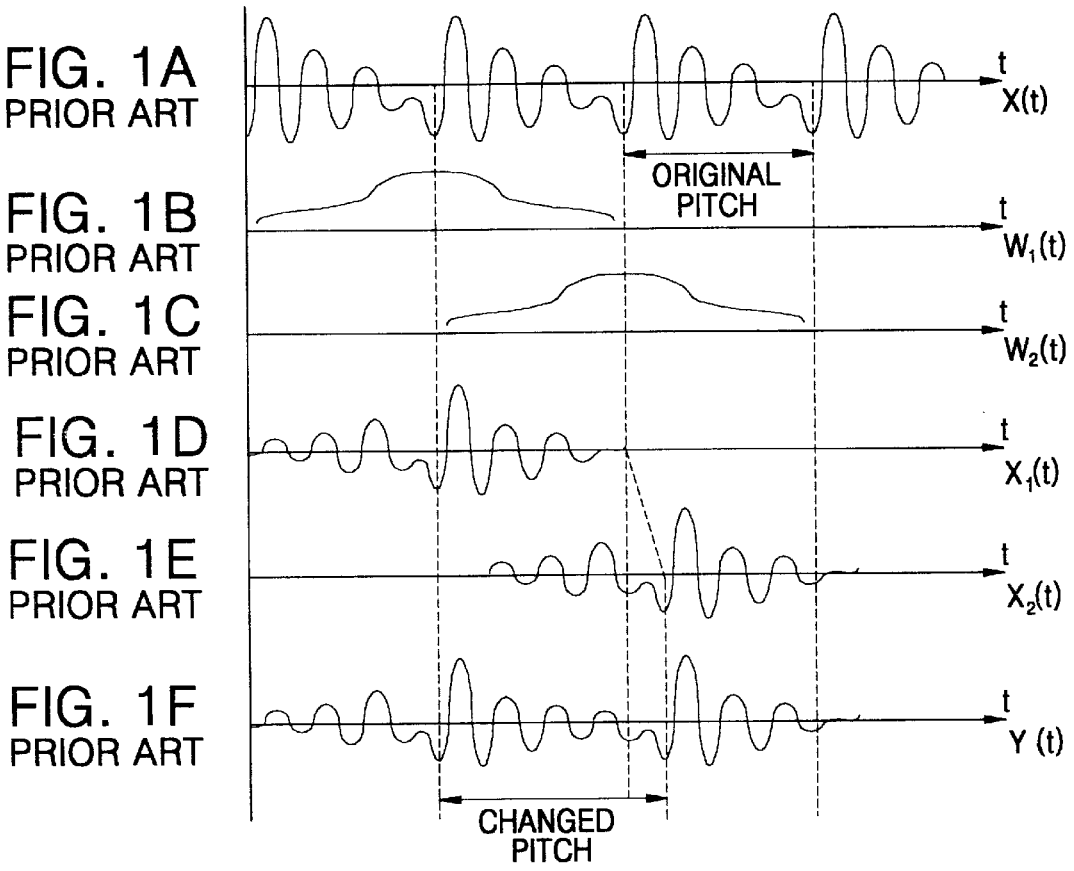
FIG. 2
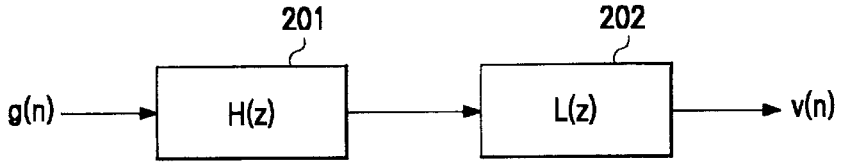

FIG. 4A
FIG. 4B
FIG. 4C
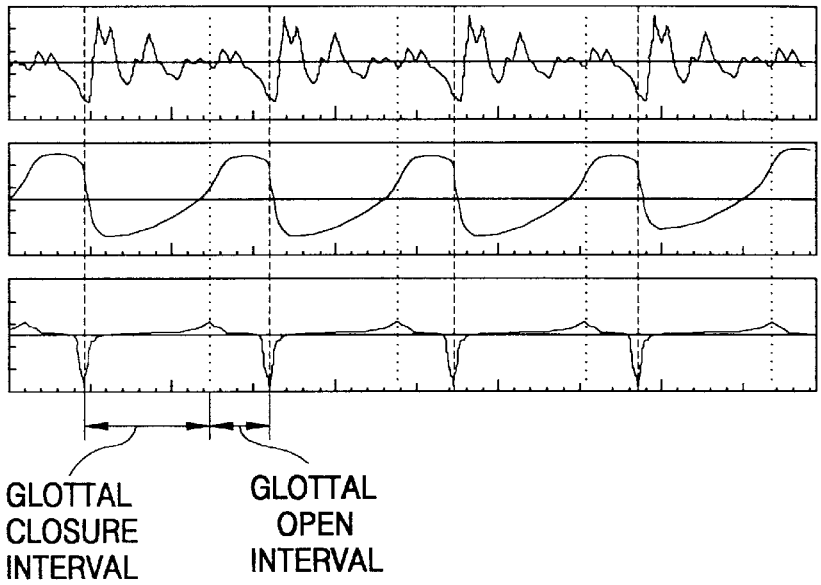
FIG. 5A
FIG. 5B
FIG. 5C
FIG. 5D
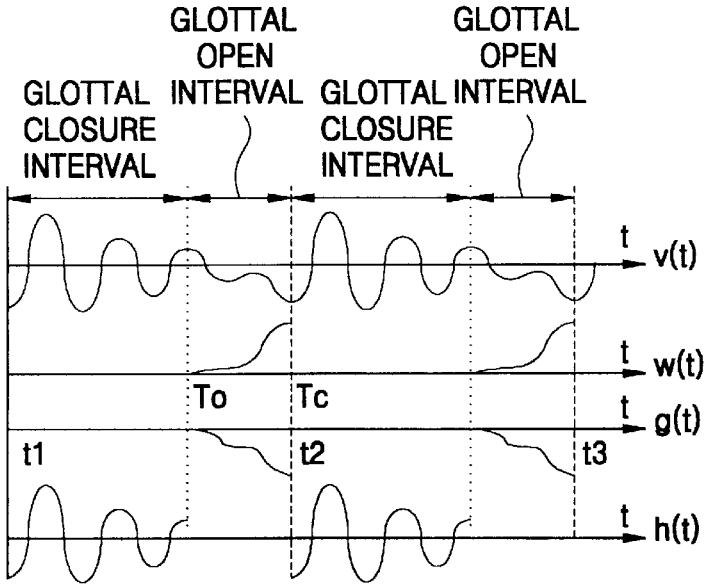

$L_{n-1}$
$L_n$
$L_{n+1}$
t
X(t)
$Ep_{n-1}$
$Ep_n$
$Ep_{n+1}$
$Ep_{n+2}$
WH(t)
$Ls_{n-1}$
$Lf_{n-1}$
$Lf_n$
$Ls_n$
$Lf_{n+1}$
$Lf_{n+2}$
$Ls_{n+1}$
$Ls_{n+2}$
$T_{n-1}$
$T_n$
$T_{n+1}$
$T_{n+2}$
SF(t)
Xp(t)
$EF_n$
$EF_{n+1}$
$EF_{n+2}$
Ws(t)
Y(t)

FIG. 8A
FIG. 8B
FIG. 8C
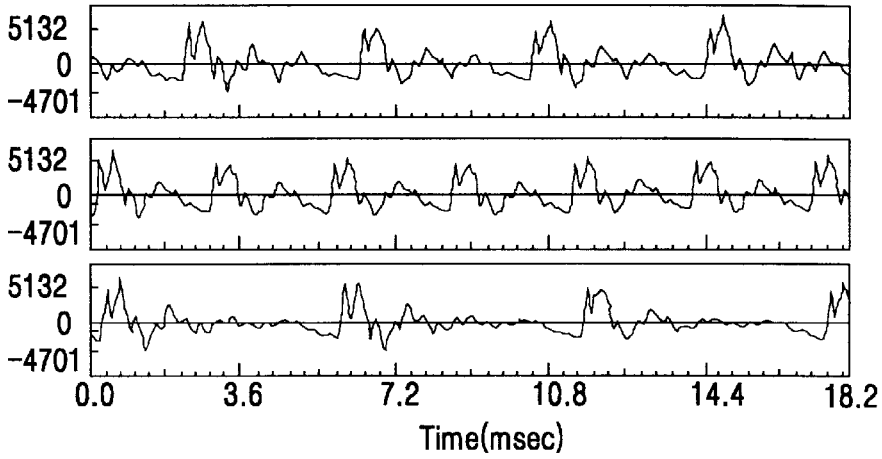
FIG. 9A
FIG. 9B
FIG. 9C
FIG. 9D
FIG. 9E
FIG. 9F
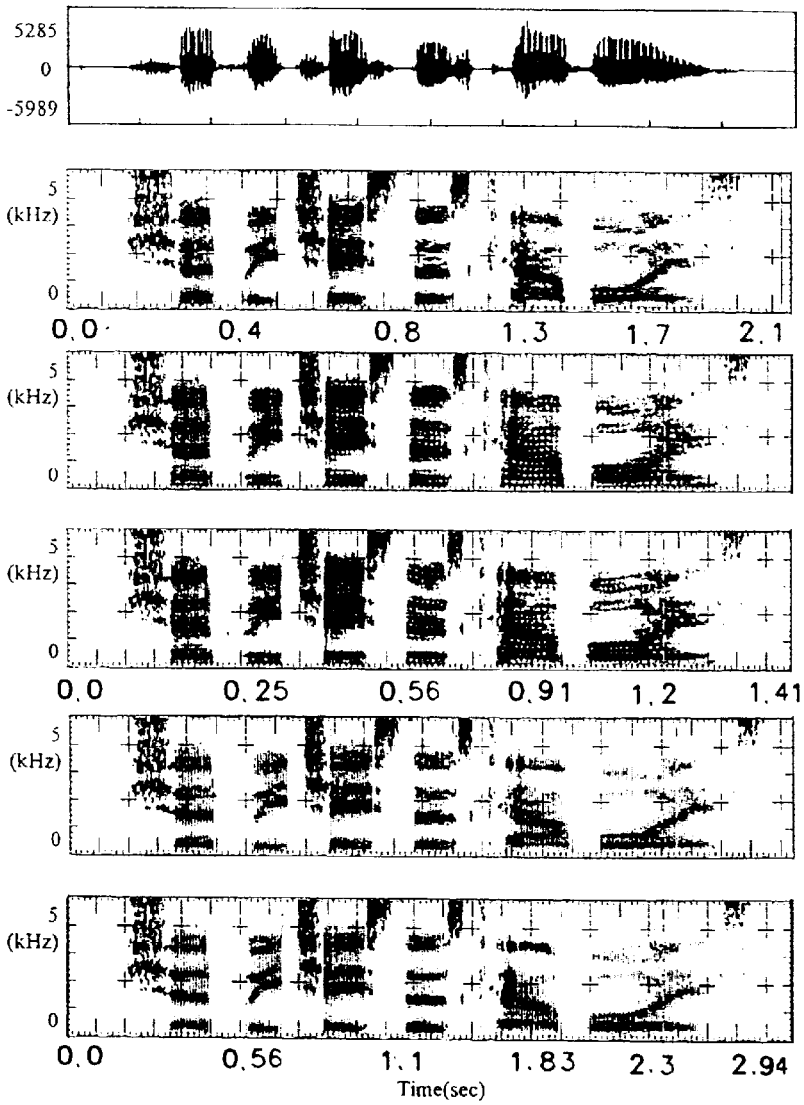

PITCH MODIFICATION METHOD BY GLOTTAL CLOSURE INTERVAL EXTRAPOLATION

BACKGROUND OF THE INVENTION

1. Field of the Invention

The present invention relates to a pitch modification method by glottal closure interval extrapolation, and particularly when concatenating original speech segments to synthesize speech, a pitch modification method which is capable of modifying pitches of the speech signals by the glottal closure interval extrapolation, while maintaining a very good quality in the modified speech.

2. Description of Related Art

Generally, speech synthesis method is classified into limited vocabulary synthesis method and non-limited vocabulary synthesis method. Formant, linear prediction coefficient (LPC), line spectrum pair (LSP) etc. of a parameter type in the non-limited vocabulary synthesis method, have been studied, these methods have a little poor quality, but have the advantage of making a variety of synthetic sounds by modifying sound source and vocal tract parameter etc. To obtain synthetic sounds of the very good quality, a pitch synchronous overlap and add (PSOLA) method has been studied as a typical scheme which varys pitches in time domain to concatenate original speech segments.

FIGS. 1A to 1F are waveforms showing steps of pitch modification by the prior art PSOLA method.

FIG. 1A is a waveform of a speech signal X(t), FIGS. 1B and 1C are waveforms of weight functions $W_1(t)$ and $W_2(t)$, and FIG. 1D is a waveform of a speech signal $X_1(t)$ obtained by multiplication of the speech signal X(t) and the weight function $W_1(t)$. FIG. 1E is a waveform of a speech signal $X_2(t)$ obtained by multiplication of the speech signal X(t) and the weight function $W_2(t)$, and FIG. 1F is a waveform of a speech signal Y(t) varying a pitch by overlapping of the speech signal $X_1(t)$ and the speech signal $X_2(t)$ as shown in FIGS. 1D and 1E.

The prior art PSOLA method includes first step of generating a first speech signal by multiplying the original speech signal by a first weight signal, second step of generating a second speech signal by multiplying the original speech signal by a second weight signal, and third step of overlapping and adding the first speech signal and the second speech signal in a desired pitch length to generate a pitch-changed speech signal.

The prior art PSOLA method is explained with reference to FIGS. 1A to 1F.

First, the original speech signal X(t) shown in FIG. 1A is multiplied by the first weight signal $W_1(t)$ shown in FIG. 1B to generate the first speech signal $X_1(t)$ shown in FIG. 1D, and the original speech signal X(t) shown in FIG. 1A is multiplied by the second weight signal $W_2(t)$ shown in FIG. 1C to generate the second speech signal $X_2(t)$ shown in FIG. 1E.

Then, the first speech signal $X_1(t)$ and the second speech signal $X_2(t)$ are overlapped and added in the desired pitch length to generate the pitch-changed speech signal Y(t).

Since the prior art PSOLA method has large effect of window which is applied by pitch unit according to increase of pitch modification rate and large spectrum distortion generated by overlap and add of two weighted speech signals, articulation of the synthetic speech is deteriorated.

SUMMARY OF THE INVENTION

An object of the present invention is to provide a pitch modification method capable of, when concatenating original speech segments to synthesize speech, modifying pitches of the speech signals by the glottal closure interval extrapolation, while maintaining a very good quality in the modified speech.

To achieve the above object, the present invention discloses a pitch modification method of voiced speech signals by glottal closure interval extrapolation comprising the steps of (a) detecting a glottal closure interval and estimating a vocal tract parameters using analyzing technique of pitch synchronous type, (b) separating vocal tract characteristic signals in the glottal closure interval and the glottal characteristic signals in a glottal open interval according to the glottal closure interval detected in step (a), (c) extrapolating or reducing the vocal tract characteristic signals in the glottal closure interval to a desired pitch length using the vocal tract parameter estimated in (a) step, and (d) overlapping and adding the extrapolated or reduced vocal tract characteristic signals in the glottal closure interval with the vocal tract and glottal characteristic signal separated in step (b) to generate a synthetic speech signal varied in a desired pitch length.

To achieve the above object, the present invention discloses a pitch modification method of voiced speech signals by glottal closure interval extrapolation comprising the steps of (a) detecting a present pitch and an epoch in input voiced speech signal of 1 frame, determining glottal closure interval using detected a pitch and an epoch, and comparing the detected present pitch with a desired pitch whether they are equal or not, (b) shifting into next frame in the case that the present pitch is equal to the desired pitch, separating vocal tract and glottal characteristic signals using weight function for separating vocal tract and glottal characteristic in the case that the present pitch is not equal to desired pitch, and comparing whether half a present pitch is longer than or equal to the desired pitch, (c) estimating vocal tract parameters, extrapolating linearly signal successive to signal of glottal closure interval using vocal tract parameters in the case that half the present pitch is shorter than the desired pitch, (d) multiplying extrapolated signal by weight function for overlapping and adding of two pitches, overlapping and adding the multiplied signal to the vocal tract and glottal characteristic signal, and judging whether input voiced speech is end of speech signal or not, in the case that half the present pitch is longer than or equal to the desired pitch or after step (c), and (e) shifting input voiced speech of current frame into that of next frame, excuting the steps (a) to (d) repeatedly in the case that input voiced speech of current frame is not end of speech signal(S709), and stopping excution of entire steps (a) to (d) in the case that input voiced speech is end of speech signal.

BRIEF DESCRIPTION OF THE DRAWINGS

Other features and objects of the present invention will be apparent from the following description in connection with the accompanying drawings.

FIGS. 1A to 1F are waveforms showing steps of pitch modification by the prior art PSOLA method;

FIG. 1A is a waveform of a speech signal X(t);

FIGS. 1B and 1C are waveforms of weight functions W1(t) and W2(t);

FIG. 1D is a waveform of a speech signal X1(t) obtained by multiplication of the speech signal X(t) and the weight function W1(t);

FIG. 1E is a waveform of a speech signal X2(t) obtained by multiplication of the speech signal X(t) and the weight function W2(t);

FIG. 1F is a waveform of a speech signal Y(t) varying a pitch by overlapping and adding of the speech signal X1(t) and the speech signal X2(t);

FIG. 2 is a block diagram showing a linear speech production system;

FIGS. 4A to 4C are waveforms showing detection results of glottal closure interval and glottal open interval by EGG signal;

FIG. 4A is a waveform of a speech signal;

FIG. 4B is a waveform of EGG (Electro Glotto Gragh) signal;

FIG. 4C is a waveform of the EGG signal which is first differentiated in which vertical solid lines indicate timings of glottal closing and vertical dashed lines indicate timings of glottal open;

FIGS. 5A to 5D are waveforms showing results of approximate separation of vocal tract and glottis characteristic signals;

FIG. 5A is a waveform of a speech signal v(t);

FIG. 5B is a waveform of a weight function w(t);

FIG. 5C is a waveform of a voice source signal g(t);

FIG. 5D is a waveform of a vocal tract characteristic signal h(t);

FIG. 6A is a waveform of a speech signal X(t);

FIG. 6B is a waveform of a weight function Wh(t) for separation of vocal tract and glottis characteristics;

FIG. 6C is a waveform of separated vocal tract and glottis characteristics signals SF(t);

FIG. 6D is a waveform of a signal Xp(t) obtained by extrapolating from the speech signals in the glottal closure interval using vocal tract characteristics;

FIG. 6E is a waveform of a weight function Ws(t) for overlapping and adding with voice source signals;

FIG. 6F is a waveform of signal Y(t) in which pitch is modified by the glottal closure interval extrapolation;

FIGS. 8A to 8C are waveforms in which pitch is changed by the method of FIG. 7;

FIG. 8A is a waveform of an original speech;

FIG. 8B is a waveform in which the original speech is reduced by 70% according to the method of FIG. 7;

FIG. 8C is a waveform in which the original speech is enlarged by 140% according to the method of FIG. 7;

FIGS. 9A to 9F are waveforms and spectrograms showing results of pitch modification with respect to a speech "Should we chase those cowboys" which is (i.e. remove space after first quotation mark and before second one); uttered by a female speaker according to the prior art PSOLA method and the present invention method of FIG. 7;

FIG. 9A is a waveform of an original speech;

FIG. 9B is a spectrogram of the speech waveform as shown in FIG. 9A;

FIG. 9C is a spectrogram in which the original speech is reduced by 70% according to the prior art PSOLA method;

FIG. 9D is a spectrogram in which the original speech is reduced by 70% according to the method of FIG. 7;

FIG. 9E is a spectrogram in which the original speech is enlarged by 140% according to the prior art PSOLA method; and FIG. 9F is a spectrogram in which the original speech is enlarged by 140% according to the method of FIG. 7.

DETAILED DESCRIPTION OF THE PREFERRED EMBODIMENTS

Figure 3:
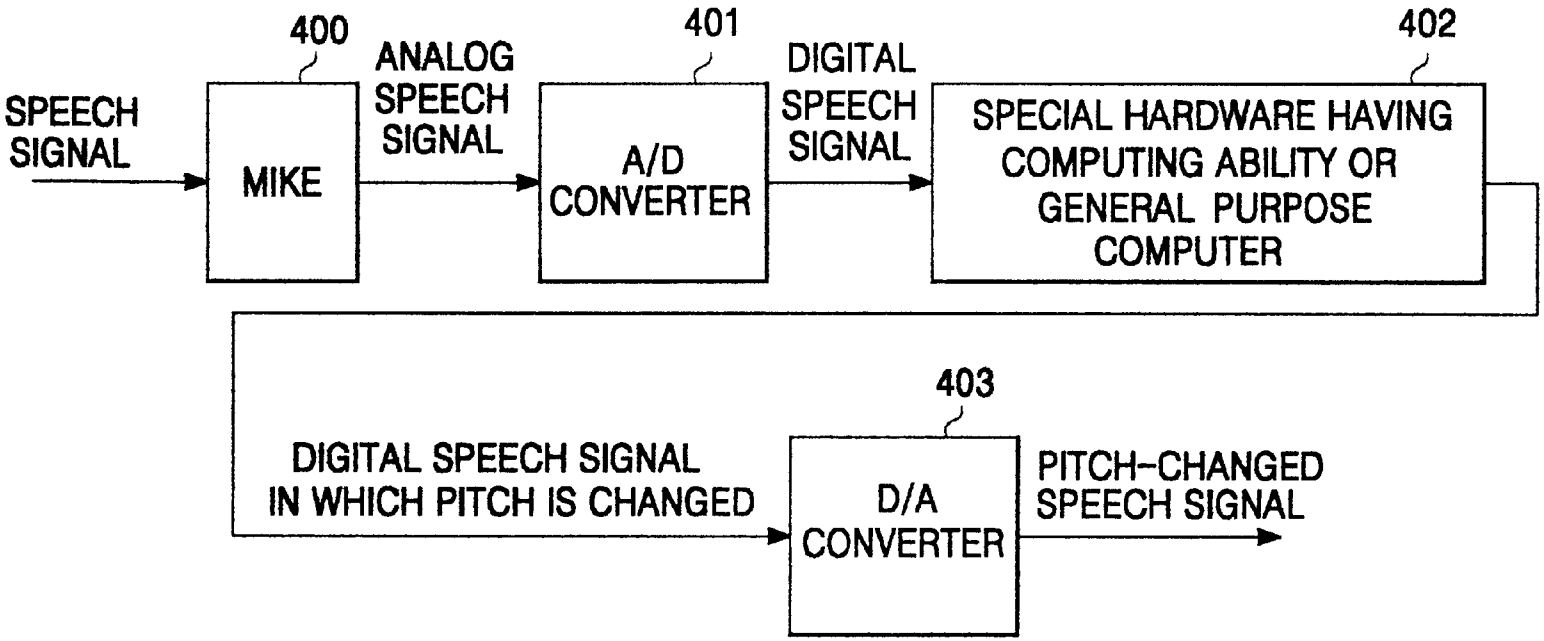
FIG. 3 is a block diagram showing a pitch modification system to which the present invention is applied.

A method of modifying pitches of voiced sound signals according to an embodiment of the present invention will now be described in detail with reference to the attached drawings.

FIG. 2 shows a linear speech production system.

Referring to FIG. 2, assuming that a voice source signal is g(n), a vocal tract function is h(n), and an uttered speech signal is v(n), modeling of speech generation can be accomplished as a linear system that the voice source is exited through a vocal tract filter 201 and a lips 202 successively.

Frequency response V(z) of a voiced speech except for a nasal sound can be expressed by the following equation (1).

$$V(z) = G(z) \times H(z) \times L(z) = \frac{G'(z)}{A(z)} = \frac{G'(z)}{1 + \sum_{k=1}^{p} a_k z^{-k}} \tag{1}$$

where $a_k$ is a linear predictive coefficient, and G' (Z)=G (Z)×L(Z).

In the case of the voiced speech, the speech production is accomplished by resonance occurring when an excitation signal due to vibration of a vocal cord passes the vocal tract.

The vocal cord makes the vibrations explained by Bernoulli effect and has characteristic of sudden closing and slow opening. The voiced speech signal is excited by its maximum energy at the time when the vocal cord is closed suddenly. When a glottis is closed, since no excitation source exists, the voiced sound signal is naturally attenuated according to structure of articulation and physical characteristic of the vocal tract. While the glottis is open slowly, natural attenuation is hindered by the open glottis and the voice source signal, so resonant frequency is changed, further sudden attenuation occurs, and the glottis is closed suddenly. Such a process is repeated.

If the equation (1) expresses another form, it can be expressed by the following equation (2).

$$v(n) = g(n) + \sum_{k=1}^{p} a_k v_{n-k} \tag{2}$$

The voice source g(n) of the equation (2) is zero or constant in a glottal closure interval. Accordingly the speech signal v(n) of the equation (2) in this interval can be modeled as a zero-input response and also includes most energy and formant information in one pitch interval. In the glottal closure interval, the vocal tract characteristics are linear and its output signals are the zero-input response because the g(n) of the equation (2) is zero.

Since analysis of speech signals in the glottal closure interval may be more correct than that of speech signals in the glottal open interval, in the case that the speech signal in the glottal open interval is inverse-filtered by the vocal tract characteristic signals obtained by analysis of speech signal in this glottal closure interval, the characteristic of voice source, i.e., glottal wave can be estimated. Therefore, if knowing information regarding the glottal closure interval and the glottal open interval in the voiced speech, the speech signal in one pitch period is separated into the voice source characteristic signal and the vocal tract characteristic signal in time domain, so that the speech signal in this glottal closure interval by equation (2) can be extrapolated or reduced linearly in time domain according to the characteristic of the vocal tract to modify the pitches of the voiced speech freely.

FIG. 3 is a block diagram showing a pitch modification system to which the present invention is applied.

As shown in FIG. 3, the pitch modification system includes a microphone 400 for converting inputted speech signal into an analog speech signal, an analog to digital (A/D) converter 401 for converting the analog speech signal of the microphone 400 into a digital speech signal, a special hardware having computing ability or general purpose computer 402 for excuting a pitch modification method by glottal closure interval extrapolation in reference to the digital speech signal of the A/D converter 401 and producing a digital speech signal in which pitch is changed, and a digital to analog (D/A) converter 403 for converting the produced digital speech signal of the special hardware having computing ability or general purpose computer 402 into an analog pitch-changed speech signal.

The operation of the pitch modification system will now be explained.

First, when a speech signal is inputted in a microphone 400, change value of speech pressure of the speech signal is converted into an electric analog speech signal through the microphone 400. The analog speech signal is converted into digital speech signal through a A/D converter 401. A special hardware having computing ability or general purpose computer 402 excutes pitch modification method by glottal closure extrapolation according to the present invention with reference to the digital speech signal of the A/D converter 401, and outputs a digital speech signal in which pitch is changed. The digital speech signal of the special hardware having computing ability or general purpose computer 402 is converted into a pitch-changed speech signal through a D/A converter 403.

As mentioned above, an pitch modification method of voiced sound signals excuted in the special hardware having computing ability or general purpose computer 402 according to the first embodiment of the present invention includes first step of detecting a glottal closure interval and estimating a vocal tract parameters using analyzing technique of pitch synchronous type, second step of separating vocal tract characteristic signals in the glottal closure interval and the glottal characteristic signals in a glottal open interval according to the glottal closure interval detected in first step, third step of extrapolating or reducing the vocal tract characteristic signals in the glottal closure interval using the vocal-tract parameter estimated in first step, and fourth step of overlapping and adding the extrapolated or reduced speech signals in the glottal closure interval with the vocal tract and glottal characteristic signal to generate a synthetic speech signal varied in a desired pitch length.

The pitch modification method of voiced sound signals will now be explained in detail with reference to FIGS. 4 to 9.

First step of the pitch modification method will now be explained in detail with reference to FIG. 4.

The glottal closure interval is detected by recording the speech together with EGG (ElectroGlottoGraph) signal capable of measuring glottis vibration. Also, the glottal closure interval is obtained by detecting epoch using a epoch detector.

In the former method, if the EGG signal shown in FIG. 4B is first differentiated, signal shown in FIG. 4C is generated. As shown in FIG. 4C, in the first differentiated signal, large peak of minus side indicates timings of glottal closing (by vertical solid lines) and small peak of plus side indicates timings of glottal open (by vertical dashed lines).

The former method has advantage that detection is easy, precision is high, and glottal open information is obtained relatively correctly, but has shortcoming that special and expensive equipment is required. The latter method using the epoch detector can use any speech, but does not know the glottal open interval and since its performance is lower than that of the former, post-processing may be executed manually.

Detection method of the glottal closure interval, which is applied to the present invention, is that the detected result in the differentiated EGG signal shown in FIG. 5C is used as the glottal closure interval in case of using the EGG signal, and the glottal closure interval is set to about 40~50% of one pitch period from the time of epoch in case of using an epoch detector by signal processing technique.

The glottal open interval is located just before the next glottal closure interval. In the case of glottal closure interval detecting method using EGG signal, the glottal open interval is set to the other interval except for the glottal closure interval in one pitch period. In the case of the glottal closure interval dectecting method using the epoch detector, the glottal open interval is set to 40–60% interval of the corresponding pitch, which is positioned before the point of glottal closure time.

In the present invention, correctness of the glottal closure interval is less than that of EGG, however, the glottal closure interval is detected using an epoch detector in consideration of general case.

Since precision of the vocal tract parameter necessary for extrapolating to the glottal closure interval effects on quality of the synthetic speech, possibly stable and correct analyzing technique is required. According to experiment, quality of original speech is maintained even though using analyzing technique of frame synchronous type, however, if pitch is too short and characteristic of vocal tract is unstable, the precision of the estimated vocal tract parameter is low, so that quality of speech is decreased. Accordingly, in this case, analyzing technique of pitch synchronous type is more precisely required.

Now, second step of the pitch modification method will now be explained in detail with reference to FIG. 5.

FIGS. 5A to 5D are ideal waveforms showing approximate separation method of vocal tract and glottal characteristic signals based on equation (2) in one pitch period of the voiced speech and principle of speech production.

As shown in FIG. 5D, a vocal tract characteristic signal h(t) is easily obtained by separating speech signal in the glottal closure interval in time domain, but since glottal characteristic signals must remove vocal tract characteristic signal from speech signal in the glottal open interval, it requires complex and correct process.

Since energy ratio of glottal and vocal tract characteristic in the glottal open interval is remarkably larger in case of the glottal characteristic, however, if large weight is given to side where the glottal characteristic of signals in the glottal open interval is large as shown in FIG. 5B, a voice source signal g(t) shown in FIG. 5C is approximately separated. Such a voice source separation method can maintain natural continuity of the speech signal in connecting between two pitches for overlapping and adding in speech synthesis.

Second step to fourth step of the pitch, modification method will now be explained in detail with reference to FIGS. 6A to 6F.

FIGS. 6A to 6F are waveforms showing steps of pitch modification method by glottal closure interval extrapolation according to an embodiment of the present invention.

Figures 6A, 6B, 6C, 6D, 6E, 6F:
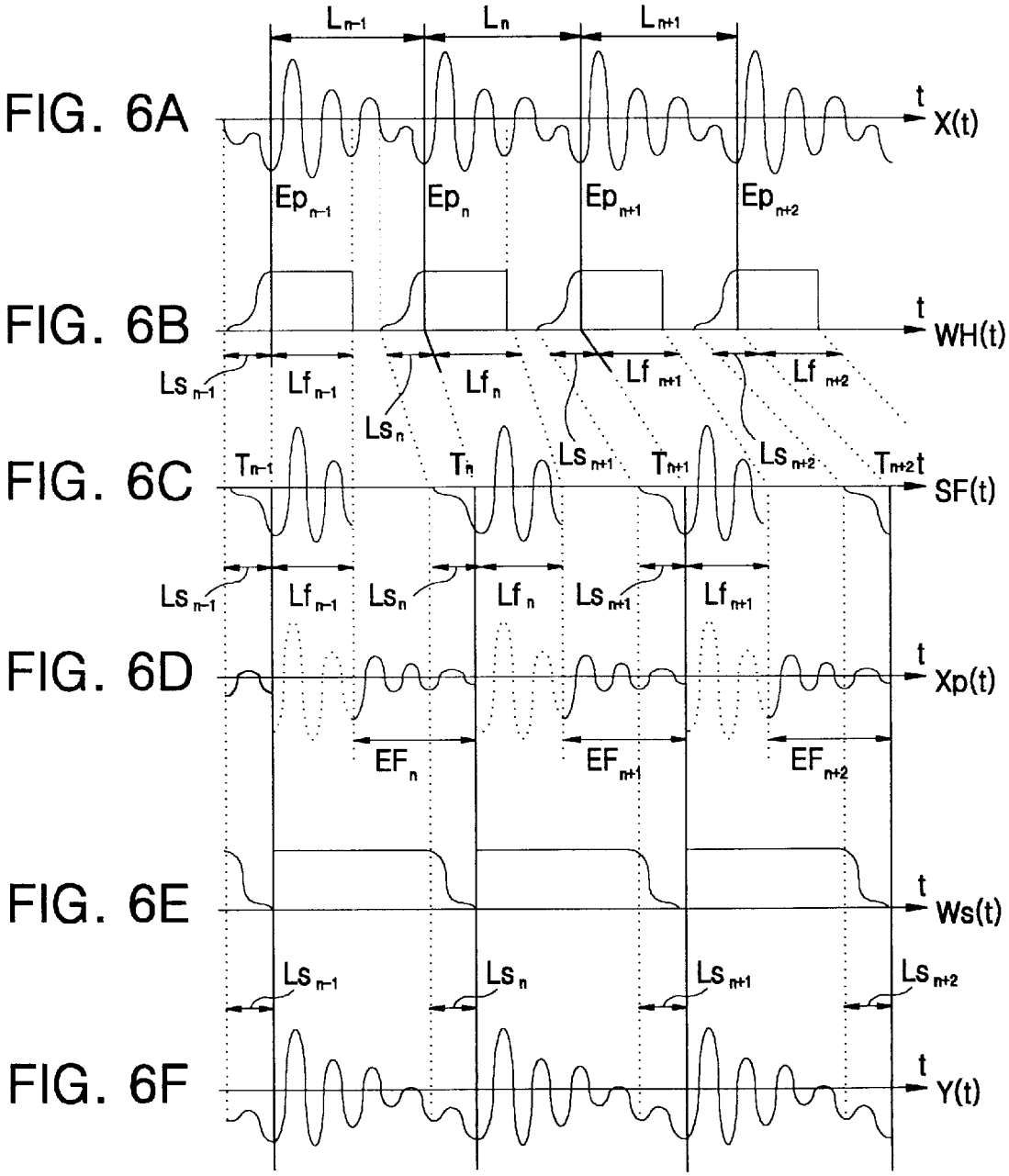
FIGS. 6A to 6F are waveforms showing steps of pitch modification method by a glottal closure interval extrapolation according to an embodiment of the present invention.

Second step separates approximately vocal tract characteristic signal in the glottal closure interval and glottal characteristic signal in the glottal open interval using a weight function Wh(t) shown in FIG. 6B. If the glottal closure interval Lf of Wh(t) is set to about 40~50% of corresponding pitch, and the glottal open interval Ls of Wh(t) is set to about 40~60% of corresponding pitch, it separates approximately the speech source.

$$Wh(t) = 0.5 - 0.5 \times \mathrm{COS}\left(\pi \frac{1}{Ls} t\right), \quad Ep_n - Ls_n \le t < Ep_n \tag{3}$$

$$Wh(t) = 1, \quad Ep_n \le t < Ep_n + Lf_n$$

$$Wh(t) = 0, \quad Ep_n + Lf_n \le t < Ep_{n+1} - Ls_{n+1}$$

where n is 0,1,2,3, , , , etc.

If signal obtained by multiplying a weight function Wh(t) of equation (3) by the speech signal is moved/located in desired pitch length (distance from $t_{n-1}$ to $t_n$ in FIG. 6C), SF(t) shown in FIG. 6C is obtained.

Third step extrapolates linear signal indicated by solid line of Xp(t) as shown in FIG. 6D in a desired pitch length continuing to speech signals in the glottal closure interval using the obtained vocal tract parameter.

Fourth step multiplies the signal Xp(t) by weight function Ws(t) to overlap the vocal tract and glottal characteristic signal SF(t) shown in FIG. 6C, thereby maintaining continuity of signal between adjacent pitches to obtain natural synthetic speech Y(t) shown in FIG. 6F as like equation (4).

$$Y(t)=Xp(t)\times Ws(t)+SF(t) \tag{4}$$

where Ws(t) is a function complementary to the weight function used for the glottal characteristic signal shown in FIG. 6B within $LS_n$ interval.

The synthetic speech of high quality can be obtained by directly overlapping and adding signal produced artificially by modeling the voice source.

Figure 7:
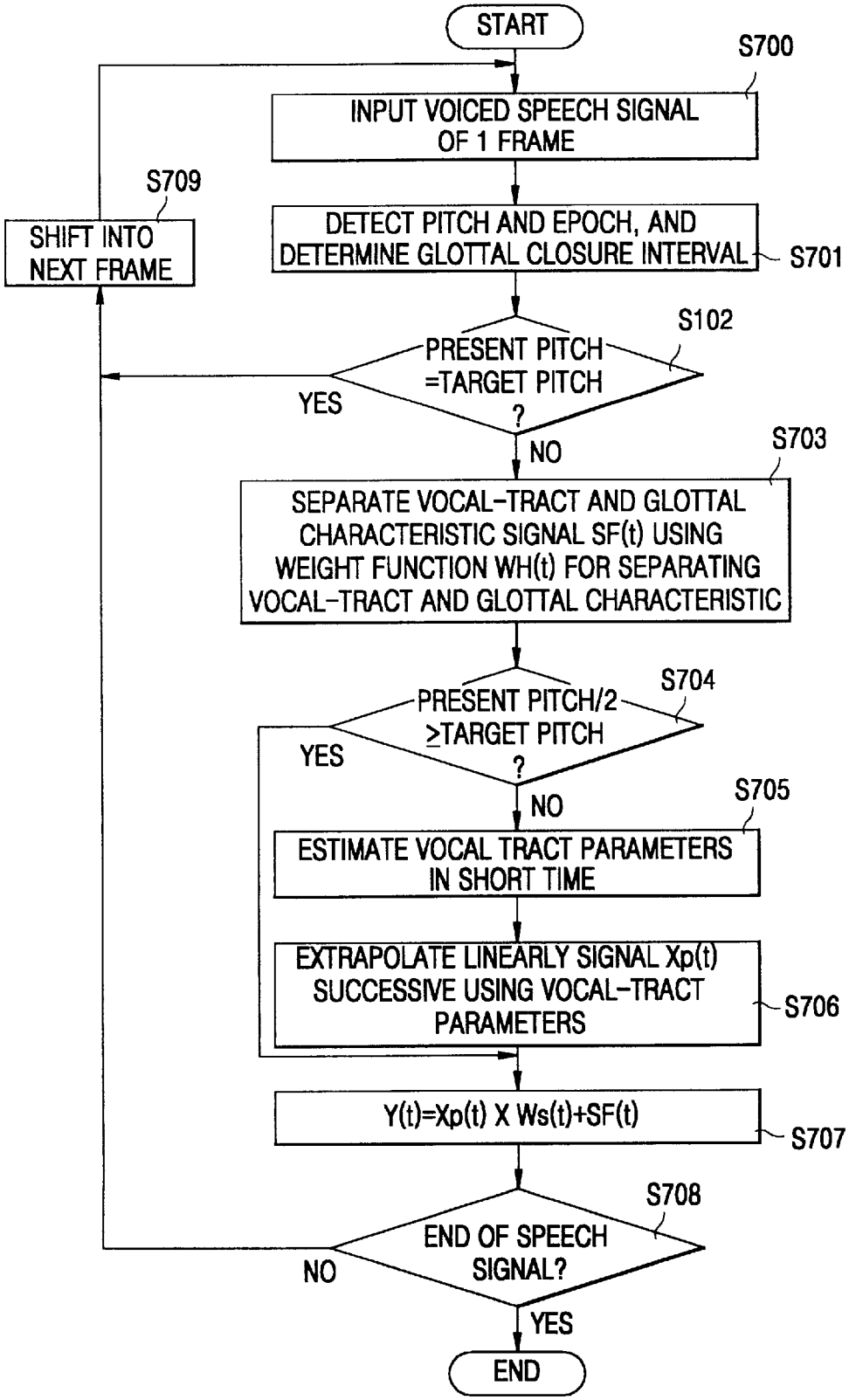
FIG. 7 is a flow chart explaining steps of pitch modification method by the glottal closure interval extrapolation according to an embodiment of the present invention.

FIG. 7 is a flow chart explaining steps of pitch modification method by glottal closure interval extrapolation according to an second embodiment of the present invention.

As shown in FIG. 7, an pitch modification method includes first step of detecting a present pitch and an epoch(S701) in input voiced speech signal of 1 frame(S700), determining glottal closure interval using detected a pitch and an epoch(S701), and comparing the detected present pitch with a desired pitch whether they are equal or not (S702), second step of shifting into next frame in the case that the present pitch is equal to the desired pitch(S709), separating vocal tract and glottal characteristic signals using weight function for separating vocal tract and glottal characteristic signal in the case that the present pitch is not equal to desired pitch(S703), and comparing whether half a present pitch is longer than or equal to the desired pitch (S704), third step of estimating vocal tract parameters (S705), extrapolating linearly signal $X_P(t)$ successive to signal of glottal closure interval using vocal tract parameters in the case that half the present pitch is shorter than the desired pitch(S706), fourth step of multiplying signal $X_P(t)$ by weight function $W_S(t)$ for overlapping and adding of two pitches, overlapping and adding the multiplied signal to the vocal tract and glottal characteristic signal SF(t)(S707), and judging whether input voiced speech is end of speech signal or not, and fifth step of shifting input voiced speech of current frame into that of next frame, excuting the steps (a) to (d) repeatedly in the case that input voiced speech of current frame is not end of speech signal(S709), and stopping excution of entire steps (a) to (d) in the case that input voiced speech is end of speech signal.

The pitch modification method by glottal closure interval extrapolation according to a second embodiment of the present invention will now explained with reference to FIGS. 6 and 7.

First, since this invention processes only voiced speech of the speech signal, after the voiced speech of one frame (about 20~30 msec) is inputted at step S700 to detect pitch and epoch, a glottal closure interval is determined at step S701.

After determining whether pitch should be modified at step S702, if necessity of change exists, the vocal tract characteristic signal in the glottal closure interval and glottal characteristic signal in the glottal open interval are separated approximately using a weight function Wh(t) of equation (3) at step S703.

If a desired pitch to be changed is equal to or shorter than half of the present pitch (i.e. the glottal closure interval), step S707 is executed without extrapolation of the glottal closure interval, but if the desired pitch is larger than half of the present pitch, after vocal tract parameter is obtained necessary for extrapolation of the glottal closure interval at step S706, signal Xp(t) continuing to speech signals in the glottal closure interval is synthesized in a desired pitch length using the obtained vocal tract parameter at step S705.

The linear synthetic signal Xp(t) succeeding to the glottal closure interval is multiplied by weight function Ws(t) to overlap and add vocal tract and glottal characteristic signal SF(t) shown in FIG. 6C.

Continuity of signal between adjacent pitches is maintained to obtain natural synthetic speech Y(t) shown in FIG. 6F at step S707. After determining end of process at step S708, if successive process is required, shift of next frame is executed at step S709.

As explained above, the present invention has the following effects as shown in FIGS. 8A to 8C and in FIGS. 9A to 9F.

Since this invention does not use window function as like PSOLA method, formant bandwidth inherent in speech is maintained to produce clear synthetic speech. Since only a portion of voice source is overlapped and added without most pitch length as like PSOLA method, spectrum distortion is small thereby allowing synthesis of high quality.

Since weight function for overlap applied to connection between two pitches and weight function applied to separation of voice source signal are equal in length, thereby minimizing effect due to weight function. Since deterioration of speech quality according to change in pitch is small, pitch can be changed widely.

Although the invention has been described with reference to particular embodiments, the description is only an example of the invention's application and should not be taken as a limitation. Various adaptation and combinations of features of the embodiments disclosed are within the scope of the invention as defined by the following claims.

What is claimed is:

1. An improved pitch modification method for producing a pitch modified digital speech signal of an input speech signal by glottal closure interval extrapolation, comprising steps of:

(a) converting said input speech signal into an electric analog speech signal;

(b) converting said electric analog speech signal into a digital speech signal;

(c) detecting a glottal closure interval in said digital speech signal, and estimating vocal tract parameters using pitch synchronous analysis;

(d) separating vocal tract characteristic signals of the glottal closure interval and glottal characteristic signals of a glottal open interval from each other according to the glottal closure interval detected at the step (c);

(e) extrapolating the vocal tract characteristic signals separated at step (d) to a desired pitch length by using the vocal tract parameter estimated at the step (c); and (f) overlapping and adding the extrapolated vocal tract characteristic signals to the glottal characteristic signal separated at step (d) so as to generate a synthetic speech signal which varies in a desired pitch length; and (g) wherein the step (f) comprises the further steps of multiplying the signal obtained at the step (e) by the weight function Wh(t), said weight function Wh(t) being as follows:

$$Wh(t) = 0.5 - 0.5 \times \mathrm{COS}\left(\pi \frac{1}{Ls} t\right), \quad Ep_n - Ls_n \le t < Ep_n$$

$$Wh(t) = 1, \quad Ep_n \le t < Ep_n + Lf_n$$

$$Wh(t) = 0, \quad Ep_n + Lf_n \le t < Ep_{n+1} - Ls_{n+1}$$

where n is 0, 1, 2, 3 , , , etc., t is time, $Ep_n$ is an epoch point, $Ls_n$ is a glottal open interval of speech signals, and $Lf_n$ is a glottal closure interval of speech signals; and (h) overlapping and adding the multiplied signal and glottal characteristic signal to generate a synthetic speech signal.

2. The pitch modification method according to claim 1, wherein the glottal closure interval detected in step (c) is 40–50% in one pitch period from the time of epoch.

3. The pitch modification method according to claim 1, wherein the glottal open interval in step (d) is 40–60% in one pitch period located just before the timing of the glottal closure interval.

4. The improved pitch modification method according to claim 1, wherein step (d) further comprises the steps of:

(d-1) generating a multiplied speech signal by multiplying the speech signal by a weight function for separating the vocal tract and glottal characteristic signal by the speech signal;

(d-2) separating the vocal tract characteristic signal and glottal characteristic signal in said multiplied speech signal; and (d-3) locating the separated signals in the desired pitch positions.

5. The improved pitch modification method according to claim 1, wherein at step (e) a signal succeeding to the speech signals in the glottal closure interval is linearly extrapolated by using the estimated vocal tract parameter.

6. An improved pitch modification method for producing a pitch modified digital speech signal of an input voiced speech signal of a subject frame of an entire voiced speech signal by glottal closure interval extrapolation, comprising steps of:

(a) converting said input voiced speech into an electric analog speech signal;

(b) converting said electric analog speech signal into a digital speech signal;

(c) detecting a present pitch and an epoch in said input voiced speech signal of the subject frame;

(d) determining a glottal closure interval using said detected present pitch and said epoch (e) determining if the detected present pitch equals a desired pitch;

(f) if the detected present pitch equals the desired pitch, then shifting into a next frame and repeating steps (a)–(d);

(g) if the detected present pitch does not equal a desired pitch, then separating a vocal tract characteristic signal and a glottal characteristic signal using a weight function Wh(t), said weight function Wh(t) being as follows:

$$Wh(t) = 0.5 - 0.5 \times \mathrm{COS}\left(\pi \frac{1}{Ls} t\right), \quad Ep_n - Ls_n \le t < Ep_n$$

$$Wh(t) = 1, \quad Ep_n \le t < Ep_n + Lf_n$$

$$Wh(t) = 0, \quad Ep_n + Lf_n \le t < Ep_{n+1} - Ls_{n+1}$$

where n 0,1,2,3, . . . etc., t is time, $Ep_n$ is an epoch, point $Ls_n$ is a glottal open interval of speech signals, and $Lf_n$ is a glottal closure interval of speech signals;

(h) determining if the glottal closure interval is smaller than the desired pitch;

(i) if half the present pitch is smaller than the desired pitch, then estimating the vocal tract parameters and extrapolating a linear signal successive to speech signals in the glottal closure interval by using vocal tract parameters;

(j) multiplying the extrapolated linear signal by said weight function for generating a multiplied signal;

(k) overlapping and adding the multiplied signal to a vocal tract and glottal characteristic signal;

(l) determining whether said input voiced speech signal is end of said entire voiced speech signal;

(m) if said input voiced speech signal is the end of said entire voiced speech signal, shifting input voiced speech signal of current frame into a next frame; and (n) if the input voiced speech signal is not the end of speech signal, repeatedly executing steps (a)–(d).

* * * * *